US008096137B2

(12) United States Patent
Czerwonky et al.

(10) Patent No.: US 8,096,137 B2
(45) Date of Patent: Jan. 17, 2012

(54) SYSTEMS AND METHODS FOR GUIDING AND SUPPORTING AN EVAPORATOR STRUCTURE

(75) Inventors: Bradford Roy Czerwonky, Peachtree City, GA (US); Randy Edward Johnson, Peachtree City, GA (US); Yusuke Kawakami, Unnan (JP)

(73) Assignee: Hoshizaki America, Inc., Peachtree City, GA (US)

( * ) Notice: Subject to any disclaimer, the term of this patent is extended or adjusted under 35 U.S.C. 154(b) by 692 days.

(21) Appl. No.: 12/241,920

(22) Filed: Sep. 30, 2008

(65) Prior Publication Data

US 2009/0084117 A1 Apr. 2, 2009

Related U.S. Application Data

(60) Provisional application No. 60/976,706, filed on Oct. 1, 2007.

(51) Int. Cl.
*F25B 45/00* (2006.01)

(52) U.S. Cl. ..... 62/77; 62/259.1

(58) Field of Classification Search ..... 62/77, 298, 62/285, 259.1, 302, 448; 312/212, 236
See application file for complete search history.

(56) References Cited

U.S. PATENT DOCUMENTS

| | | | | |
|---|---|---|---|---|
| 2,638,755 | A * | 5/1953 | Borgerd | 62/262 |
| 4,307,778 | A * | 12/1981 | Tobin et al. | 165/125 |
| 4,457,140 | A * | 7/1984 | Rastelli | 62/261 |
| 4,505,129 | A * | 3/1985 | Yamane et al. | 62/280 |
| 5,193,355 | A * | 3/1993 | Matsumi | 62/262 |
| 5,374,118 | A * | 12/1994 | Kruck et al. | 312/407 |
| 6,014,868 | A | 1/2000 | Hirosawa et al. | |
| 6,082,131 | A | 7/2000 | Hirosawa et al. | |
| 6,116,038 | A | 9/2000 | Yamada et al. | |
| 6,192,701 | B1 * | 2/2001 | Goth et al. | 62/259.2 |
| 6,997,005 | B2 * | 2/2006 | Haasis | 62/258 |
| 7,367,197 | B1 * | 5/2008 | Reil et al. | 62/89 |
| 7,418,827 | B2 * | 9/2008 | Rios | 62/285 |
| 7,669,641 | B2 * | 3/2010 | Rembold et al. | 165/53 |

* cited by examiner

*Primary Examiner* — Mohammad Ali
(74) *Attorney, Agent, or Firm* — Sutherland Asbill & Brennan LLP

(57) ABSTRACT

Embodiments of the invention can include systems and methods for guiding and supporting an evaporator structure with respect to a refrigeration unit. In one embodiment, a system can include a guide rail adapted to mount to a housing associated with a refrigeration unit, and a guide support adapted to mount to an evaporator structure, wherein the guide support can be aligned with the guide rail, and the guide support can maintain close proximity to the guide rail when the evaporator structure is moved adjacent to the refrigeration unit. In other embodiments, associated methods of use and installation for the system can be provided.

20 Claims, 6 Drawing Sheets

SYSTEMS AND METHODS FOR GUIDING AND SUPPORTING AN EVAPORATOR STRUCTURE

RELATED APPLICATION

This application claims priority to U.S. Ser. No. 60/976,706, entitled "System and Methods for Guiding and Supporting an Evaporator Structure", filed Oct. 1, 2007, the contents of which are incorporated herein by reference.

FIELD OF THE INVENTION

The invention generally relates to refrigeration, and more particularly relates to system and methods for guiding and supporting an evaporator structure.

BACKGROUND OF THE INVENTION

A refrigerator or refrigeration unit is essentially a temperature-controlled device with an insulated box and an evaporator to maintain contained items, such as food, within a desired temperature range. The refrigerator or refrigeration unit can be housed in a particular space, such as a kitchen, dining, or refreshment area. The insulated box and evaporator are often in close proximity to each other since the refrigeration system is configured to blow relatively cold air into the insulated box containing items to be maintained within the desired temperature range.

In some instances, an evaporator or other component associated with a refrigerator or refrigeration unit may need service or maintenance. In these instances, ease of access to the evaporator or other component can minimize the time needed to service or maintenance the evaporator or other component. One conventional evaporator associated with an under the counter refrigerator can slide outward from under the counter to permit access to components of the evaporator and/or the insulated box. Example of an under the counter refrigerator with an evaporator and insulated box are disclosed in U.S. Pat. Nos. 6,014,868 and 6,082,131. However, common problems with respect to this conventional configuration are failures related to sliding the evaporator with respect to the insulated box and/or counter, damage to the evaporator and/or insulated box during pre-installation shipping, and the inability to return the evaporator to the same or about the same operating position after service and maintenance.

Therefore, there is a need for systems and methods for guiding and supporting an evaporator structure.

There is also a need for systems and methods for providing an evaporator support guide rail for guiding and supporting an evaporator structure.

SUMMARY OF THE INVENTION

Some or all of the above needs can be addressed by embodiments of the invention. Embodiments of the invention can include systems and methods for guiding and supporting an evaporator structure with respect to an insulated box associated with a refrigerator. In general, embodiments of the invention can be used with an evaporator structure associated with a refrigerator to guide and support the evaporator structure with respect to an insulated box associated with the refrigerator. In many instances, embodiments of the invention can facilitate service and maintenance for the evaporator structure, insulated box, or other component associated with a refrigerator.

In one embodiment of the invention, a method of guiding and supporting an evaporator structure with respect to a refrigeration unit can be provided. The method can include providing a guide rail, and mounting the guide rail with respect to a housing associated with a refrigeration unit. The method can also include mounting a guide support to an evaporator structure, and aligning the guide support with the guide rail, wherein the guide support maintains close proximity to the guide rail when the evaporator structure is moved adjacent to the refrigeration unit.

In one aspect of this embodiment, the method can include sliding the guide support along the guide rail, wherein the evaporator structure can be moved adjacent to or away from the refrigeration unit.

In another aspect of the embodiment, providing a guide rail can include providing an upper mounting portion and a lower track portion.

In another aspect of the embodiment, providing a guide support can include providing a mount and an extension.

In another aspect of the embodiment, aligning the guide support with the guide rail can include aligning an extension associated with the guide support with a lower track portion associated with the guide rail, wherein the extension is in close proximity to the guide rail, and the extension can be in close proximity with the guide rail along a substantial portion of the guide rail when the guide support is moved with respect to the guide rail.

In another aspect of the embodiment, the mounting the guide rail with respect to a housing associated with a refrigeration unit can include mounting the guide rail to a lower surface and at least one lateral surface, wherein each associated with the housing.

In another aspect of the embodiment, mounting a guide support to an evaporator structure can include mounting the guide support to an upper portion of the evaporator structure.

In another embodiment, a system for guiding and supporting an evaporator structure with respect to a refrigeration unit can be provided. The system can include a guide rail adapted to mount to a housing associated with a refrigeration unit, and a guide support adapted to mount to an evaporator structure, wherein the guide support can be aligned with the guide rail, and the guide support can maintain close proximity to the guide rail when the evaporator structure is moved adjacent to the refrigeration unit.

In one aspect of this embodiment, the guide rail can include an upper mounting portion and a lower track portion.

In another aspect of the embodiment, the guide support can include a mount and an extension.

In another aspect of the embodiment, a lower track portion of the guide rail can be aligned with an extension associated with the guide support, wherein the extension can be in close proximity to the lower track portion, and the extension can be in close proximity with the lower track portion when the guide support is moved with respect to the guide rail.

In another aspect of the embodiment, the guide rail is mounted to a lower surface and at least one lateral surface, wherein each surface is associated with the housing.

In another aspect of the embodiment, the guide support is mounted to an upper portion of the evaporator structure.

In another aspect of the embodiment, the guide rail can include a square-S cross-section shaped track, and the guide support can include a square-C cross-section shaped extension.

In yet another embodiment, a method for using an evaporator structure guide and support apparatus with respect to a refrigeration unit can be provided. The method can include removing an evaporator structure with a guide support from a housing with a guide rail, and aligning the guide support with the guide rail, wherein the guide support maintains close proximity to the guide rail. The method can also include replacing the evaporator structure within the housing, wherein the guide support maintains close proximity to the guide rail when the evaporator structure is moved adjacent to the refrigeration unit.

In one aspect of this embodiment, the method can also include sliding the guide support along the guide rail, wherein the evaporator structure can be moved adjacent to or away from the refrigeration unit.

In another aspect of the embodiment, the guide rail can include an upper mounting portion and a lower track portion.

In another aspect of the embodiment, the guide support can include a mount and an extension.

In another aspect of the embodiment, aligning the guide support with the guide rail can include aligning an extension associated with the guide support with a lower track portion associated with the guide rail, wherein the extension is in close proximity to the guide rail, and the extension can be in close proximity with the guide rail along a substantial portion of the guide rail when the guide support is moved with respect to the guide rail.

In another aspect of the embodiment, the guide rail is mounted to a lower surface and at least one lateral surface associated with the housing, and the guide support is mounted to an upper portion of the evaporator structure.

Other embodiments and aspects of the invention will become apparent from the following description taken in conjunction with the following drawings.

BRIEF DESCRIPTION OF THE DRAWINGS

These and other aspects, features, and advantages of the present invention are better understood when the following Detailed Description is read with reference to the accompanying drawings, wherein.

DETAILED DESCRIPTION OF DISCLOSED EMBODIMENTS

Some or all embodiments of the invention can provide systems and methods for guiding and supporting an evaporator structure. In many instances, an evaporator structure can be associated with a refrigeration unit. Both the evaporator structure and associated refrigeration unit may be installed beneath or otherwise adjacent to a counter or other surface within a confined area. In one embodiment of the invention, an evaporator guide rail and guide support can be installed with respect to an evaporator structure associated with a refrigeration unit. The evaporator guide rail and guide support can cooperate with each other to facilitate guiding and supporting the evaporator structure with respect to the associated refrigeration unit. In another embodiment, a method for guiding and supporting an evaporator structure can be provided.

The terms "refrigerator" and "refrigeration unit" are used herein to primarily refer to an insulated box and other structural components associated with a typical refrigerator or refrigeration unit.

The terms "evaporator" and "evaporator structure" are used herein to primarily refer to an evaporator or other device that facilitates a desired temperature for an associated refrigerator or refrigeration unit. Other components may be associated with an evaporator or evaporator structure including, but not limited to, a compressor, and a support frame for the evaporator and compressor.

Figure 1:
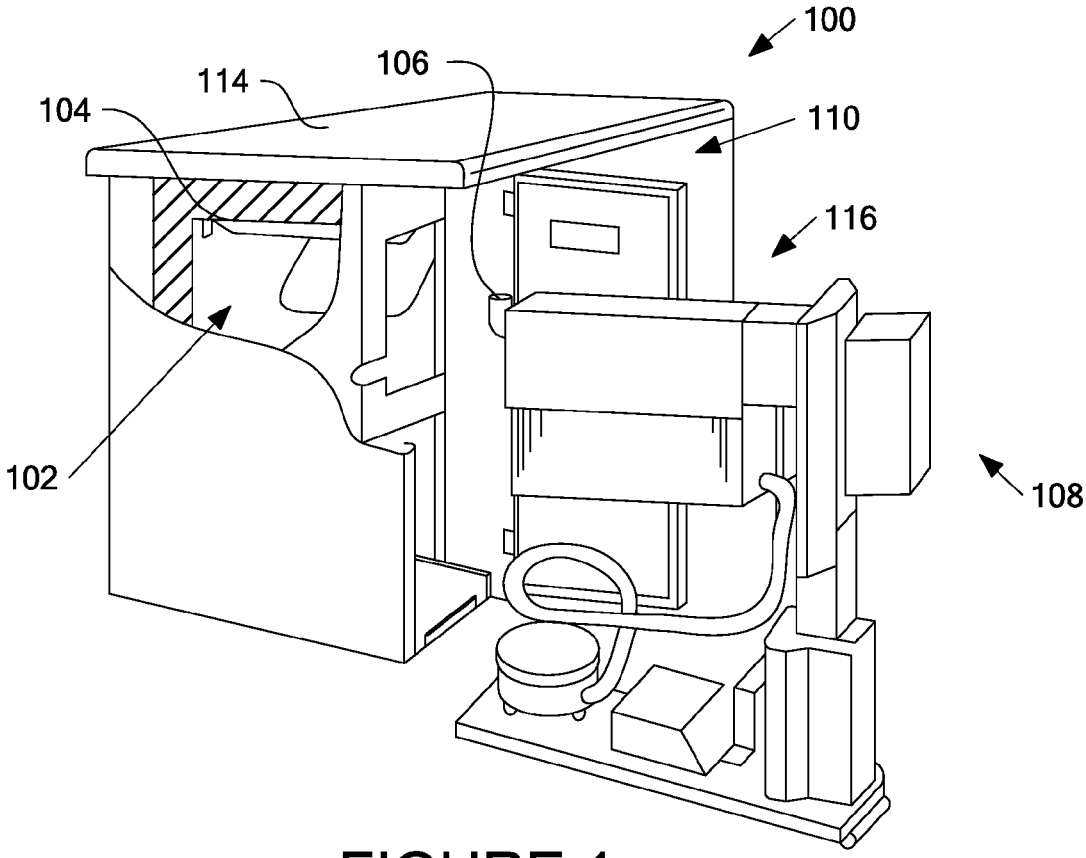
FIG. 1 shows perspective view of a system in accordance with an embodiment of the invention.

An example environment for system and method embodiments are shown in FIG. 1. In this example, a suitable environment 100 for a system 102 is an under the counter space suitable for housing an evaporator structure and associated refrigeration unit. The space beneath or under a counter or surface may or may not include an associated structure or device for an evaporator structure to fit within and adjacent to the associated refrigeration unit. As used herein, the term "housing" can be defined as the space, area, structure, or device for an evaporator structure to fit within or adjacent to an associated refrigeration unit. The system 102 shown in FIG. 1 can include an evaporator guide rail and guide support, shown respectively as 104 and 106, and can be installed with respect to an evaporator structure and associated refrigeration unit, shown respectively as 108 and 110. In some instances, the evaporator guide rail 104 and guide support 106 can be collectively referred to as an evaporator structure guide and support apparatus. Other views of the system 102 are shown in FIGS. 2-5. Systems according to other embodiments of the invention can have fewer or greater numbers of components, may have similar or different configurations, or may be oriented differently with respect to an evaporator structure and associated refrigeration unit.

Figure 3:
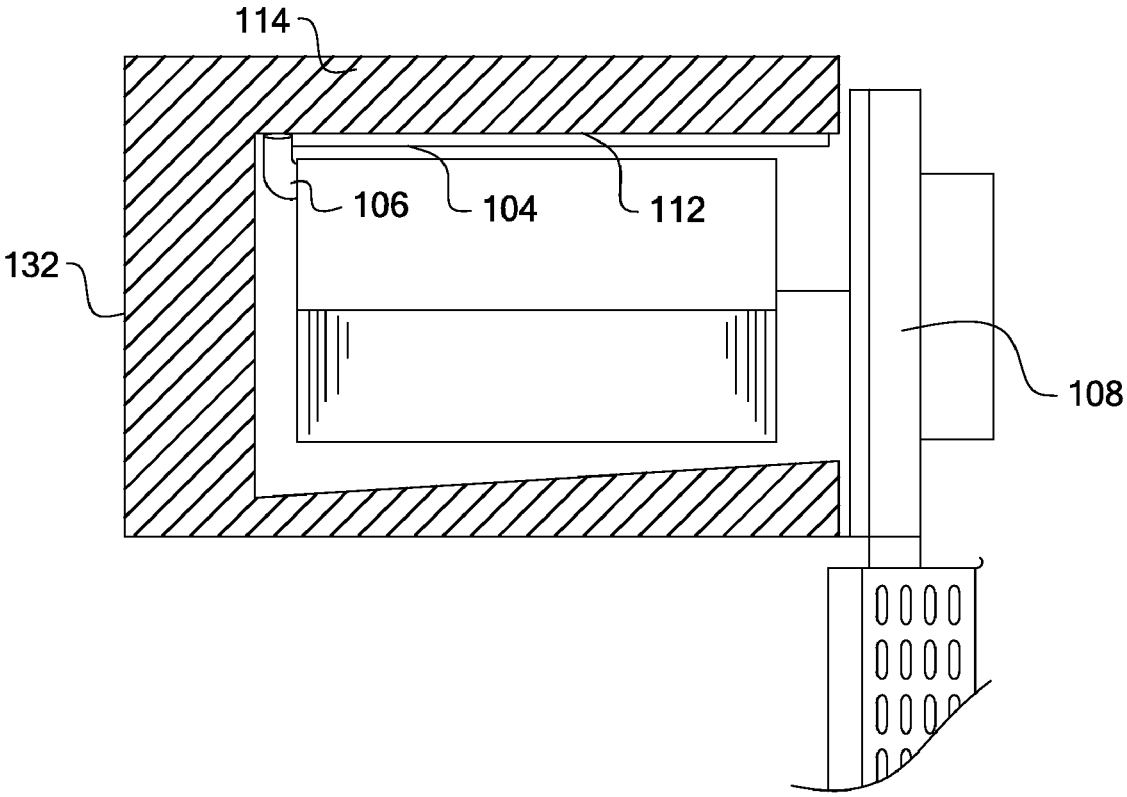
FIG. 3 shows a side view of the system shown in FIGS. 1 and 2 in accordance with an embodiment of the invention.
Figure 4:
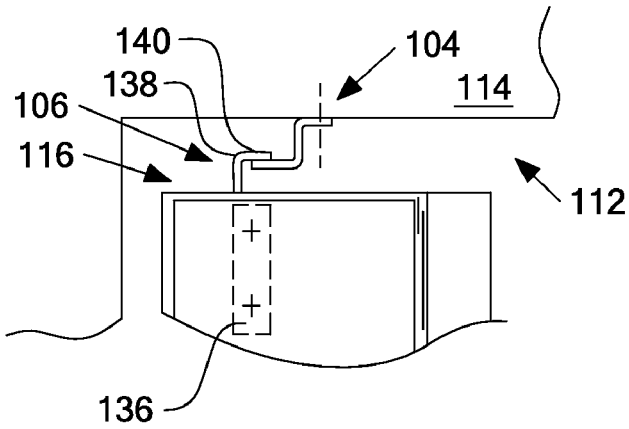
FIG. 4 shows a detail view of a system with an associated evaporator unit in accordance with an embodiment of the invention.

In FIG. 1, the evaporator guide rail 104 can be installed with respect to a lower surface 112 associated with a counter 114 or other surface. The corresponding guide support 106 can be installed with respect to an upper portion 116 of the evaporator structure 108. When the evaporator structure 108 is moved in close proximity to and in alignment with the lower surface 112 of the counter 114, the guide support 106 can be aligned with the evaporator guide rail 104 such that the guide support 106 and evaporator guide rail 104 can be in substantial contact with each other, for example, as shown in FIGS. 3 and 4. When the evaporator guide rail 104 and guide support 106 are suitably mounted with respect to the evaporator structure 108, the evaporator structure 108 can be guided and supported in a suitable orientation with respect to the refrigeration unit 110.

Figure 2:
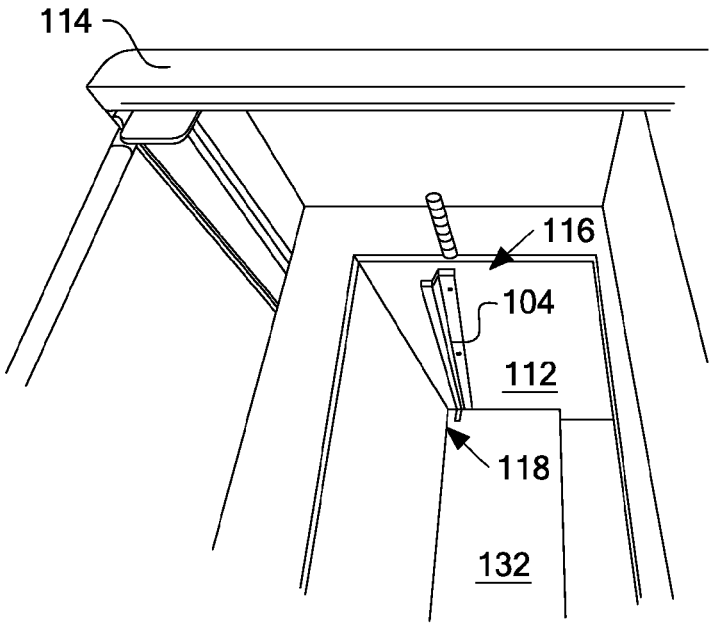
FIG. 2 shows a front perspective view of the system shown in FIG. 1 in accordance with an embodiment of the invention.

FIG. 2 illustrates a front perspective view of the evaporator guide rail 104 in FIG. 1. In this embodiment, the evaporator guide rail 104 can be positioned in a lengthwise orientation with respect to the lower surface 112 of the counter 114. That is, a leading portion 116 of the evaporator guide rail 104 can be positioned adjacent to a front portion of the counter 114, and a trailing portion 118 of the evaporator guide rail 104 can be positioned adjacent to a rear portion of the counter 114. In other embodiments, an evaporator guide rail 104 can be oriented in a different position with respect to the a counter or other surface.

In the embodiment shown, the evaporator guide rail 104 can be have an elongated shape or configuration with a rail portion 120 having a square S-shaped cross-section, and a lateral mounting portion 122 having a square L-shaped cross-section. The rail portion 120 can include an upper mounting portion 124, a lower track portion 126, and an intermediate portion 128 disposed between the upper mounting portion 124 and lower track portion 126. The upper mounting portion 124 of the evaporator guide rail 104 can be configured to mount to the lower surface 112 of the counter 114. In one instance, one or more bolts or other fastening-type devices can be used with a corresponding series of bolt holes or slots 130 machined in the upper mounting portion 124 to mount the evaporator guide rail 104 to the lower surface 112 of the counter 114.

Additional support for an evaporator guide rail can be provided by mounting a portion of the guide rail to a second surface associated with the counter or other surface. As shown in FIGS. 1 and 2, the lateral mounting portion 122 can be mounted to a lateral surface associated with the counter 114, such as a side or rear wall 132. As further shown in FIG. 5, the lateral mounting portion 122 can be configured to extend from a portion of the evaporator guide rail 104 with a slight incline or transition from the guide rail 104. The slight incline or transition can, during pre-installation transport, facilitate the decrease in relative movement of an associated evaporator structure with respect to the housing or refrigeration unit 110, when the guide support 106 is in close proximity to the guide rail 104 and the lateral mounting portion 122.

The lateral mounting portion can further be configured to mount to a lateral surface or rear wall 132 associated with the counter 114. In one instance, one or more bolts or other fastening-type devices can be used with a corresponding series of bolt holes or slots 134 machined in the lateral mounting portion 122 to mount the evaporator guide rail 104 to the rear wall 130 of the counter 114.

The lower track portion 126 of the evaporator guide rail 104 can be configured to extend from and mount to an adjacent intermediate portion 128 of the evaporator guide rail 104, which can be adjacent to the upper mounting portion 124 of the evaporator guide rail 104. In the configuration shown, the lower track portion 126 and intermediate portion 128 of the evaporator guide rail 104 can be configured to engage or otherwise be in substantial contact with at least a portion of the guide support 106.

Components for a guide rail can be made from steel or other durable materials in accordance with embodiments of the invention. In other embodiments of the invention, various components for an evaporator guide rail can have different shapes and/or configurations.

Figure 5:
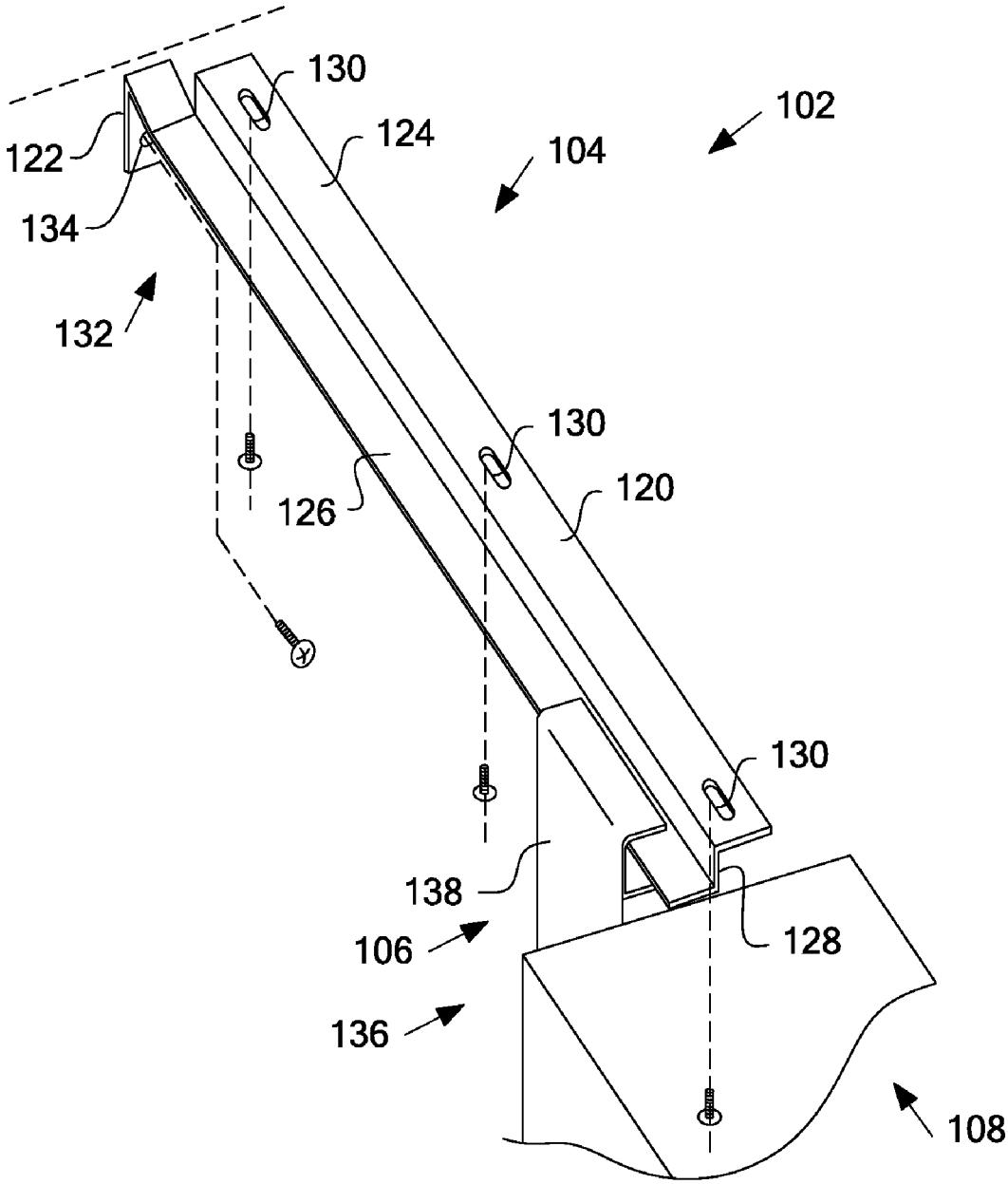
FIG. 5 shows an overhead perspective view of a system in accordance with an embodiment of the invention.
Figure 6:
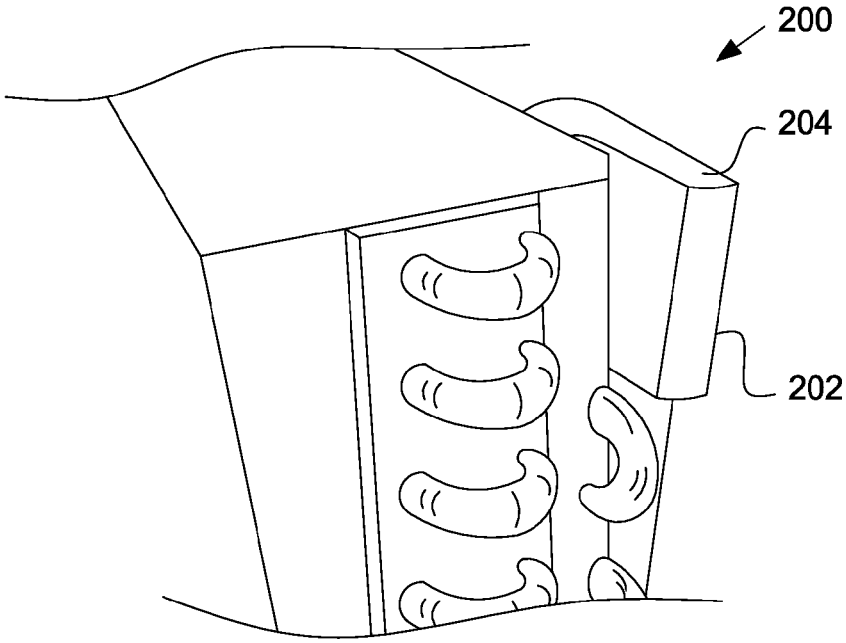
FIG. 6 shows a rear view of an evaporator structure with an example guide support in accordance with an embodiment of the invention.
Figure 7:
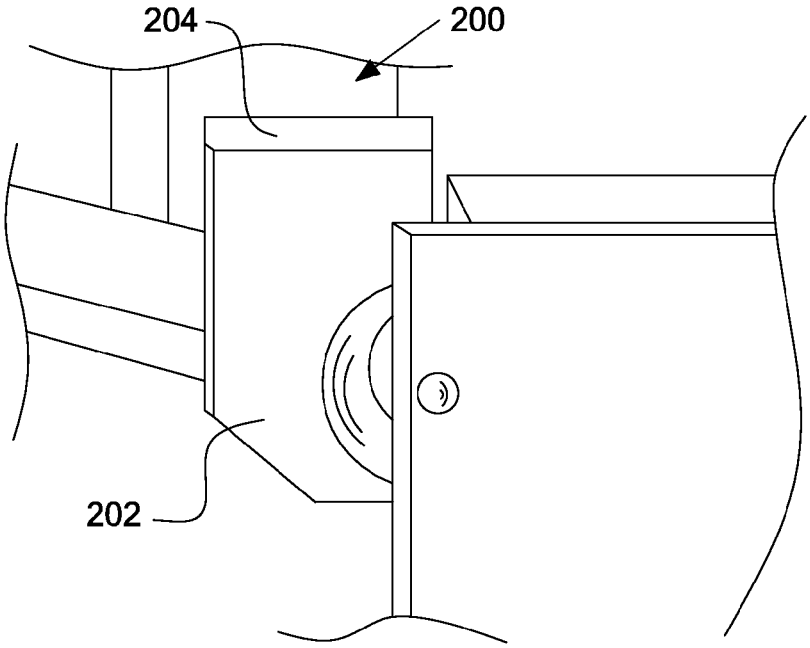
FIG. 7 shows a side view of the example guide support shown in FIG. 6 in accordance with an embodiment of the invention.

As shown in FIGS. 3, 4, and 5, the guide support 106 can be configured to engage or otherwise be in substantial contact with at least a portion of the evaporator guide rail 104. In this embodiment, the guide support 106 can include a mount 136 and an extension 138. The mount 136 can be a rectangular-shaped piece configured to mount to a portion of the evaporator structure 108. Other examples of an example guide support 200 with a mount 202 and extension 204 are shown in FIGS. 6 and 7. In one instance, as shown in FIG. 5, a series of bolts can be used to support the mount 136 from an upper portion of the evaporator structure 108. The extension 138 can be a C-shaped structure configured to extend from the mount 136, and can be configured to engage or otherwise be in substantial contact with at least a portion of the evaporator guide rail 104. As shown in FIG. 4, an upper portion 140 of the extension 138 can be in contact with or otherwise in close proximity to the lower track portion 126 of the evaporator guide rail 104. As shown in FIGS. 4 and 5, the upper portion 140 of the extension 138 can be in contact with the lower track portion 126 along a portion of the length of the lower track portion 126. In one embodiment, the lower track portion 126 of the evaporator guide rail 104 can slide within, or in close proximity to, and along the C-shaped structure of the extension 138. In the manner described above, an evaporator guide rail and guide support can guide and support an evaporator structure with respect to a refrigeration unit.

Components for a guide support can be made from steel or other durable materials in accordance with embodiments of the invention. In other embodiments of the invention, various components for a guide support can have different shapes and/or configurations.

Figure 8:
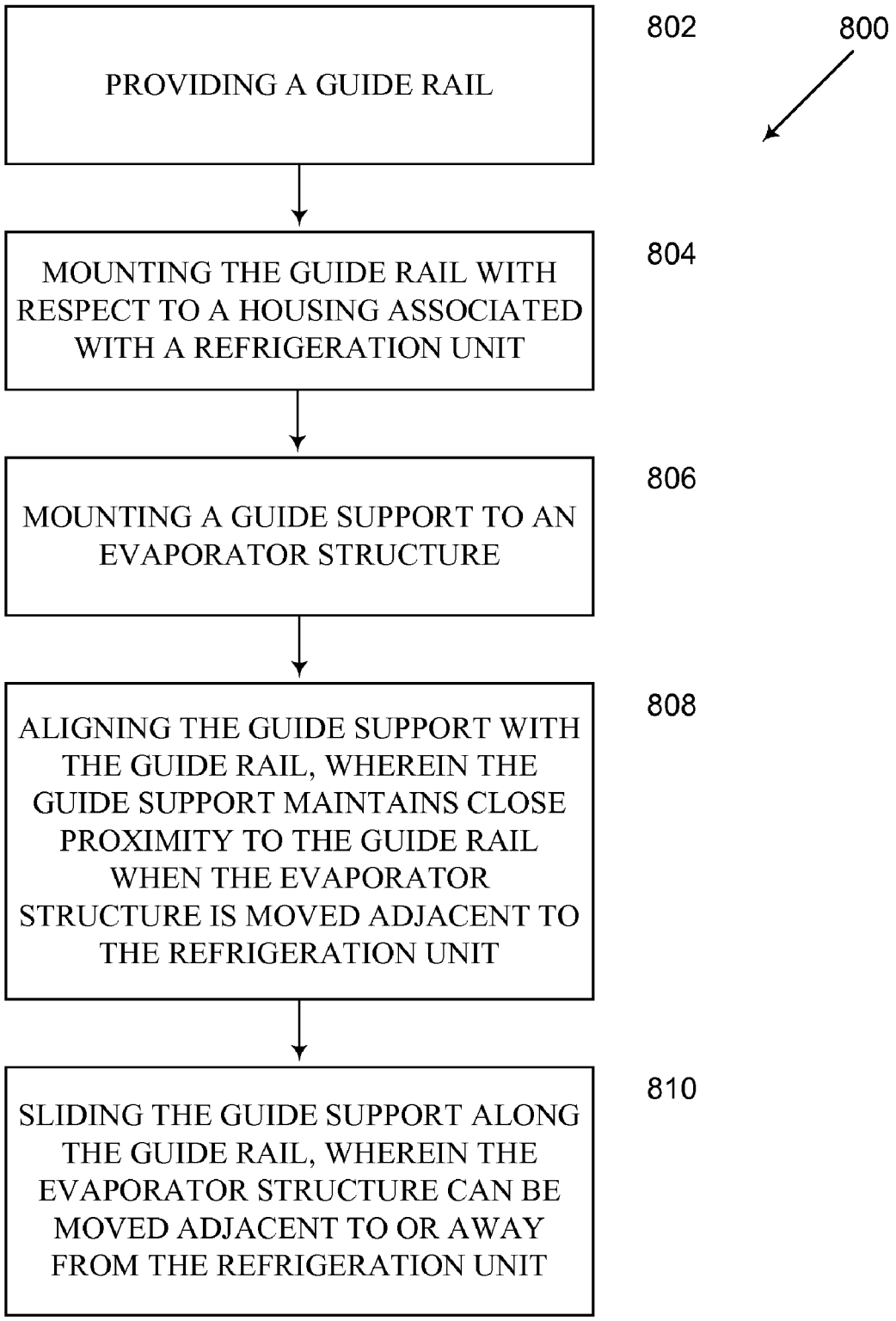
FIG. 8 shows an example process flowchart for a method in accordance with an embodiment of the invention.

In FIG. 8, an example method for guiding and supporting an evaporator structure guide is illustrated. The method can be used with the system 102 described in FIGS. 1-5, and with the guide support 200 shown in FIGS. 6 and 7. Other method embodiments can have fewer or greater numbers of elements, and may incorporate some or all of the elements described herein.

The method 800 can begin at block 802. At block 802, a guide rail can be provided. In this embodiment, a guide rail, such as evaporator guide rail 104 in FIG. 5 can be provided. In one embodiment, a guide rail can include an upper mounting portion, such as 124 in FIG. 5, a lower track portion, such as 126 in FIG. 5, and an intermediate portion, such as 128 in FIG. 5. A guide rail can have different shapes, sizes and/or configurations in accordance with other embodiments of the invention.

Block 802 is followed by block 804, in which the guide rail is mounted with respect to a housing associated with a refrigeration unit. In this embodiment, a guide rail, such as evaporator guide rail 104 in FIG. 5, can be mounted to a lower surface of a counter, such as 112 in FIGS. 3 and 4. In one embodiment, a guide rail, such as 104, can be mounted to a lower surface of a counter, such as 112, using one or more bolts or other fastening-type devices used with a corresponding series of bolt holes or slots, such as 130 in FIG. 5, machined in the guide rail 104. Other mounting devices and processes can be used with a guide rail in accordance with other embodiments of the invention.

Block 804 is followed by block 806, in which the guide support is mounted to an evaporator structure. In this embodiment, a guide support, such as guide support 106 in FIG. 5, can be mounted to a upper portion of an evaporator structure, such as 108 in FIG. 5. In one embodiment, a guide support, such as 106, can be mounted to an upper surface of an evaporator structure, such as 108, using one or more bolts or other fastening-type devices used with a corresponding series of bolt holes or slots, as shown in FIG. 4. Other mounting devices and processes can be used with a guide support in accordance with other embodiments of the invention.

Block 806 is followed by block 808, in which the guide support is aligned with the guide rail, wherein the guide support maintains close proximity to the guide rail when the evaporator structure is moved adjacent to the refrigeration unit. In this embodiment, a guide support, such as guide support 106 in FIG. 5, can be aligned with a guide rail, such as 104 in FIG. 5, mounted to a counter, such as 114 in FIGS. 3 and 4. In one embodiment, a guide support, such as 106, with an extension, such as 138 in FIG. 5, can be aligned with a lower track portion, such as 126 in FIG. 5 associated with a guide rail, such as 104. In this example, the extension 138 can be in close proximity to the guide rail 104, and the extension 138 can be in close proximity with the guide rail 104 along a substantial portion of the guide rail 104 when the guide support 106 is moved with respect to the guide rail 104. Other alignment devices and processes can be used with a guide support and guide rail in accordance with other embodiments of the invention.

Block 808 is followed by block 810, in which the guide support can be slid along the guide rail, wherein the evaporator structure can be moved adjacent to or away from a refrigeration unit. In this embodiment, when a guide support, such as guide support 106 in FIG. 5, is aligned with a guide rail, such as 104 in FIG. 5, mounted to a counter, such as 114 in FIGS. 3 and 4, the evaporator structure can be moved adjacent to or away from a refrigeration unit.

In block 810, the method 800 ends.

Figure 9:
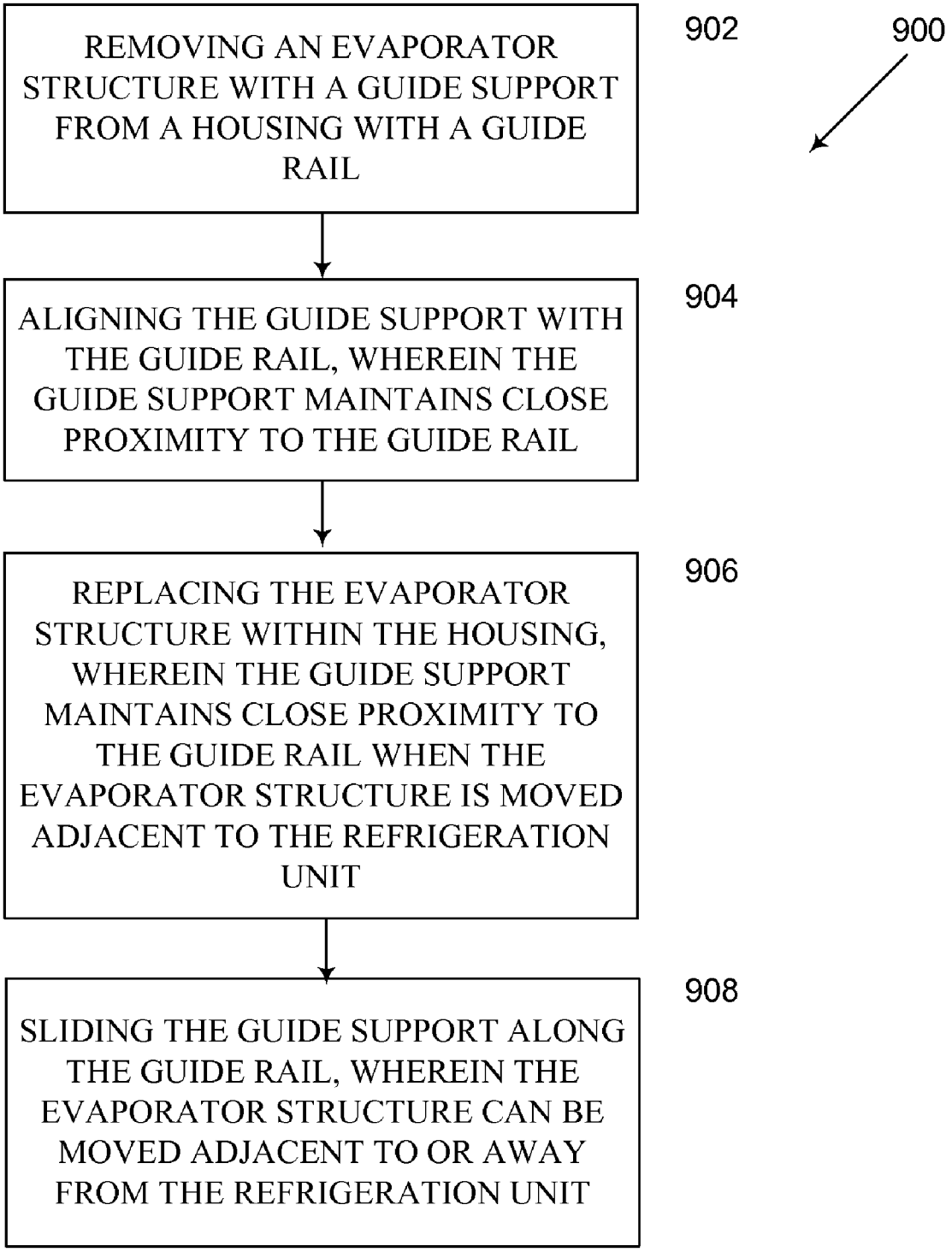
FIG. 9 shows an example process flowchart for another method in accordance with an embodiment of the invention.

In FIG. 9, an example method for guiding and supporting an evaporator structure guide is illustrated. The method can be used with the system 102 described in FIGS. 1-5, and with the guide support 200 shown in FIGS. 6 and 7. Other method embodiments can have fewer or greater numbers of elements, and may incorporate some or all of the elements described herein.

The method 900 can begin at block 902. At block 902, a an evaporator structure with a guide support can be removed from a housing with a guide rail. In this embodiment, an evaporator structure with a guide support, such as evaporator structure 108 with guide support 106 in FIG. 1, can be removed from a housing with a guide rail, such as a space beneath a counter with a guide rail, such as counter 112 and guide rail 104 in FIG. 1.

Block 902 is followed by block 904, in which the guide support is aligned with the guide rail, wherein the guide support maintains close proximity to the guide rail. In this embodiment, a guide support, such as 106 in FIG. 5, can be aligned with a guide rail, such as evaporator guide rail 104 in FIG. 5, and the guide support 106 and guide rail 104 can maintain close proximity with each other.

Block 904 is followed by block 906, in which the evaporator structure is replaced within the housing, wherein the guide support maintains close proximity to the guide rail when the evaporator structure is moved adjacent to the refrigeration unit. In this embodiment, an evaporator structure, such as 108, can be moved with respect to a lower surface under a counter, such as 112 and 114 in FIG. 2. In this example, the guide support 106 can maintain close proximity to the guide rail 104 when the evaporator structure 108 is moved adjacent to a refrigeration unit, such as 110 in FIG. 1.

Block 906 is followed by block 908, in which the guide support is slid along the guide rail, wherein the evaporator structure can be moved adjacent to or away from the refrigeration unit. In this embodiment, a guide support 106 can be slid along the guide rail 104 mounted to a counter 114. In this example, the evaporator structure 108 can be moved adjacent to or away from the refrigeration unit 110.

In block 908, the method 900 ends.

One skilled in the art will recognize other configurations, shapes, and designs for an apparatus can exist in accordance with other embodiments of the invention. It will be recognized by those skilled in the art that changes may be made in the above described embodiments of the invention without departing from the concepts thereof. The invention is not limited to the particular embodiments disclosed, but is intended to cover all modifications that are within the scope of the invention.

The invention claimed is:

1. A method of guiding and supporting an evaporator structure with respect to a refrigeration unit, the method comprising:

providing a guide rail, wherein the guide rail comprises a square-S cross-section shaped track;

mounting the guide rail with respect to a housing associated with the refrigeration unit;

mounting a guide support to an evaporator structure, wherein the guide support comprises a square-C or square-L cross-section shaped extension; and aligning the guide support with the guide rail, wherein the guide support maintains close proximity to the guide rail when the evaporator structure is moved adjacent to the refrigeration unit.

2. The method of claim 1, further comprising:

sliding the guide support along the guide rail, wherein the evaporator structure can be moved adjacent to or away from the refrigeration unit.

3. The method of claim 1, wherein providing a guide rail comprises providing an upper mounting portion and a lower track portion.

4. The method of claim 1, wherein providing a guide support comprises providing a mount and an extension.

5. The method of claim 1, wherein aligning the guide support with the guide rail comprises aligning an extension associated with the guide support with a lower track portion associated with the guide rail, wherein the extension is in close proximity to the guide rail, and the extension can be in close proximity with the guide rail along a substantial portion of the guide rail when the guide support is moved with respect to the guide rail.

6. The method of claim 1, wherein mounting the guide rail with respect to a housing associated with a refrigeration unit comprises mounting the guide rail to a lower surface and at least one lateral surface, wherein each is associated with the housing.

7. The method of claim 1, wherein mounting a guide support to an evaporator structure comprises mounting the guide support to an upper portion of the evaporator structure.

8. A system for guiding and supporting an evaporator structure with respect to a refrigeration unit, the system comprising:

a guide rail adapted to mount to a housing associated with the refrigeration unit wherein the guide rail comprises a square-S cross-section shaped track; and a guide support adapted to mount to an evaporator structure, wherein the guide support comprises a square-C or square-L cross-section shaped extension, and wherein the guide support can be aligned with the guide rail, and the guide support can maintain close proximity to the guide rail when the evaporator structure is moved adjacent to the refrigeration unit.

9. The system of claim 8, wherein the guide rail comprises an upper mounting portion and a lower track portion.

10. The system of claim 8, wherein the guide support comprises a mount and an extension.

11. The system of claim 8, wherein a lower track portion of the guide rail can be aligned with an extension associated with the guide support, wherein the extension can be in close proximity to the lower track portion, and the extension can be in close proximity with the lower track portion when the guide support is moved with respect to the guide rail.

12. The system of claim 8, wherein the guide rail is mounted to a lower surface and at least one lateral surface, wherein each surface is associated with the housing.

13. The system of claim 8, wherein the guide support is mounted to an upper portion of the evaporator structure.

14. The system of claim 8, wherein the guide rail comprises a square-C or square-L cross-section shaped track, and the guide support comprises a square-S cross-section shaped extension.

15. A method for using an evaporator structure guide and support apparatus with respect to a refrigeration unit, the method comprising:

removing an evaporator structure with a guide support from a housing with a guide rail, wherein the guide support comprises a square-C or square-L cross-section shaped extension and wherein the guide rail comprises a square-S cross-section shaped track;

aligning the guide support with the guide rail, wherein the guide support maintains close proximity to the guide rail; and replacing the evaporator structure within the housing, wherein the guide support maintains close proximity to the guide rail when the evaporator structure is moved adjacent to the refrigeration unit.

16. The method of claim 15, further comprising:

sliding the guide support along the guide rail, wherein the evaporator structure can be moved adjacent to or away from the refrigeration unit.

17. The method of claim 15, wherein the guide rail comprises an upper mounting portion and a lower track portion.

18. The method of claim 15, wherein the guide support comprises a mount and an extension.

19. The method of claim 15, wherein aligning the guide support with the guide rail comprises aligning an extension associated with the guide support with a lower track portion associated with the guide rail, wherein the extension is in close proximity to the guide rail, and the extension can be in close proximity with the guide rail along a substantial portion of the guide rail when the guide support is moved with respect to the guide rail.

20. The method of claim 15, wherein the guide rail is mounted to a lower surface and at least one lateral surface associated with the housing, and the guide support is mounted to an upper portion of the evaporator structure.

* * * * *